US007028688B1

(12) United States Patent
Grove et al.

(10) Patent No.: US 7,028,688 B1
(45) Date of Patent: Apr. 18, 2006

(54) OPERATIONALLY ADAPTABLE CHEMICAL-BIOLOGICAL MASK

(75) Inventors: Corey M. Grove, Red Lion, PA (US); Stephen E. Chase, Jarrettsville, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 63 days.

(21) Appl. No.: 11/100,233

(22) Filed: Apr. 5, 2005

(51) Int. Cl.
*A62B 18/00* (2006.01)

(52) U.S. Cl. ..... 128/201.25; 128/201.22; 128/206.17; 128/206.15

(58) Field of Classification Search ..... 128/201.22, 128/201.25, 205.25, 205.27, 205.29, 201.23, 128/206.17
See application file for complete search history.

(56) References Cited

U.S. PATENT DOCUMENTS 3,957,044 A * 5/1976 Fletcher et al. ..... 128/202.22
5,016,625 A * 5/1991 Hsu et al. ..... 128/201.25
5,140,980 A * 8/1992 Haughey et al. ..... 128/201.25
H1316 H * 6/1994 McGuinness ..... 128/201.25
5,669,375 A * 9/1997 Dahrendorf et al. ... 128/206.17
5,875,775 A * 3/1999 Nur et al. ..... 128/201.28
5,884,336 A * 3/1999 Stout ..... 2/206
6,158,429 A * 12/2000 Gardner et al. ..... 128/201.25
6,763,835 B1 * 7/2004 Grove et al. ..... 128/857
6,834,646 B1 * 12/2004 Alon et al. ..... 128/201.22

* cited by examiner

*Primary Examiner*—Henry Bennett
*Assistant Examiner*—Dinnatia Doster-Greene
(74) *Attorney, Agent, or Firm*—Ulysses John Biffoni

(57) ABSTRACT

A chemical-biological protective mask having a weight distribution that imparts a balanced center-of-gravity to the wearer of the mask, and is adaptable for different operational requirements by adjusting or altering the air flow through the mask. The protective mask includes a head covering to fully cover the wearer's head including a hood, a face piece having a visor contoured to the wearer's face, ducting within the mask connected to a filtering system mounted at the rear of the head covering and a purge airflow through the hood. Additional side or front mounted filters can be added to provide either parallel or series filtration with the rear mounted filters. A blower system may also be used to impart an airflow into the mask and improve breathing resistance.

18 Claims, 9 Drawing Sheets

OPERATIONALLY ADAPTABLE CHEMICAL-BIOLOGICAL MASK

GOVERNMENT INTEREST

The invention described herein may be manufactured, licensed, and used by or for the U.S. Government.

BACKGROUND OF THE INVENTION

1. Field of the Invention

This present invention relates to chemical-biological protective equipment. More particularly, the present invention relates to improved gas masks for protection from chemical-biological hazards, wherein said masks can be tailored or adapted for different operational capabilities.

2. Brief Description of the Related Art

Problematic with current chemical and/or biological protective masks is the lack of comfort and balance. Previously, chemical and/or biological combat masks were generally fitted with face-mounted filters for providing filtered air to the mask face-piece. Such combat mask filtration systems are capable of filtering particulate, gas and vapor hazards. In addition, some commercial masks are designed to permit the incorporation of additional face-mounted filters by stacking the filters in series, i.e., so that air flow passes through each filter before reaching the user, as required based on the hazard. Typically, these masks use canisters which may be connected to one another in series. However, these face-mounted filters adversely affect the center-of-gravity of the mask, reduce downward field-of-view, and interfere with weapon and display sights. Furthermore, stacking face mounted filters in series further exacerbates these problems and also adds breathing resistance to the wearer. Still other masks include the addition of a face-mounted blower to assist with breathing resistance. However, such face mounted blowers also exacerbate the aforementioned problems. In contrast, chemical-biological aircrew and combat vehicle masks generally have body-mounted filters for providing air to the mask. As with the masks referred to above, additional body-mounted filters may be incorporated by stacking the filters in series, or a body-mounted blower may be added. However, these body-mounted filters require a hose assembly that adds bulk, restricts movement, and interferes with body-mounted systems. Stacking filters with these body-mounted blowers also further exacerbates these problems. For example, stacking filters in series adds breathing resistance to the wearer, which has already been increased with the addition of a hose assembly.

Thus, there is a need for improved chemical-biological protective masks which can provide a balanced center-of-gravity, greater field-of-view and comfort, and decreased breathing resistance and stress on the wearer. The present invention addresses these and other needs.

SUMMARY OF THE INVENTION

The present invention provides a chemical-biological protective mask having a head covering effective for fully covering the wearer's head, wherein the aft top section of the head covering comprises a hood, and the front section of said head covering comprises a face piece having at least one visor, and wherein said hood and said face piece are integrally connected, an air supply port positioned at the rear of the head covering or hood for permitting air supply into the head covering, one or more filters mounted in combination with the rear mounted air supply port to cleanse air flowing into the head covering, and ducting from the rear-mounted air supply port to the face piece conductively adjacent to the head covering for transfer of the filtered air into the face piece. In a most preferred embodiment, one or more additional filters are mounted within the side of the head covering. Advantageously, the present invention may also include blowers or other like systems to aid in the flow of ambient air through the filters and into the head covering and face piece.

The present invention increases the comfort, balance and visual field-of-view of the wearer over known protective masks by shifting the center-of-gravity from the front of the protective mask to a point closer to the center of the wearer's head and over the shoulders.

DETAILED DESCRIPTION OF THE PREFERRED EMBODIMENT

The present invention provides improvements in the art of chemical-biological protective masks. In particular, the chemical-biological protective mask of the present invention comprises a mask having improved head comfort and center-of-gravity while maintaining chemical-biological protection for the wearer (also referred to herein as the "user") and reducing breathing resistance by providing alternative filtered airflow patterns.

Figure 1:
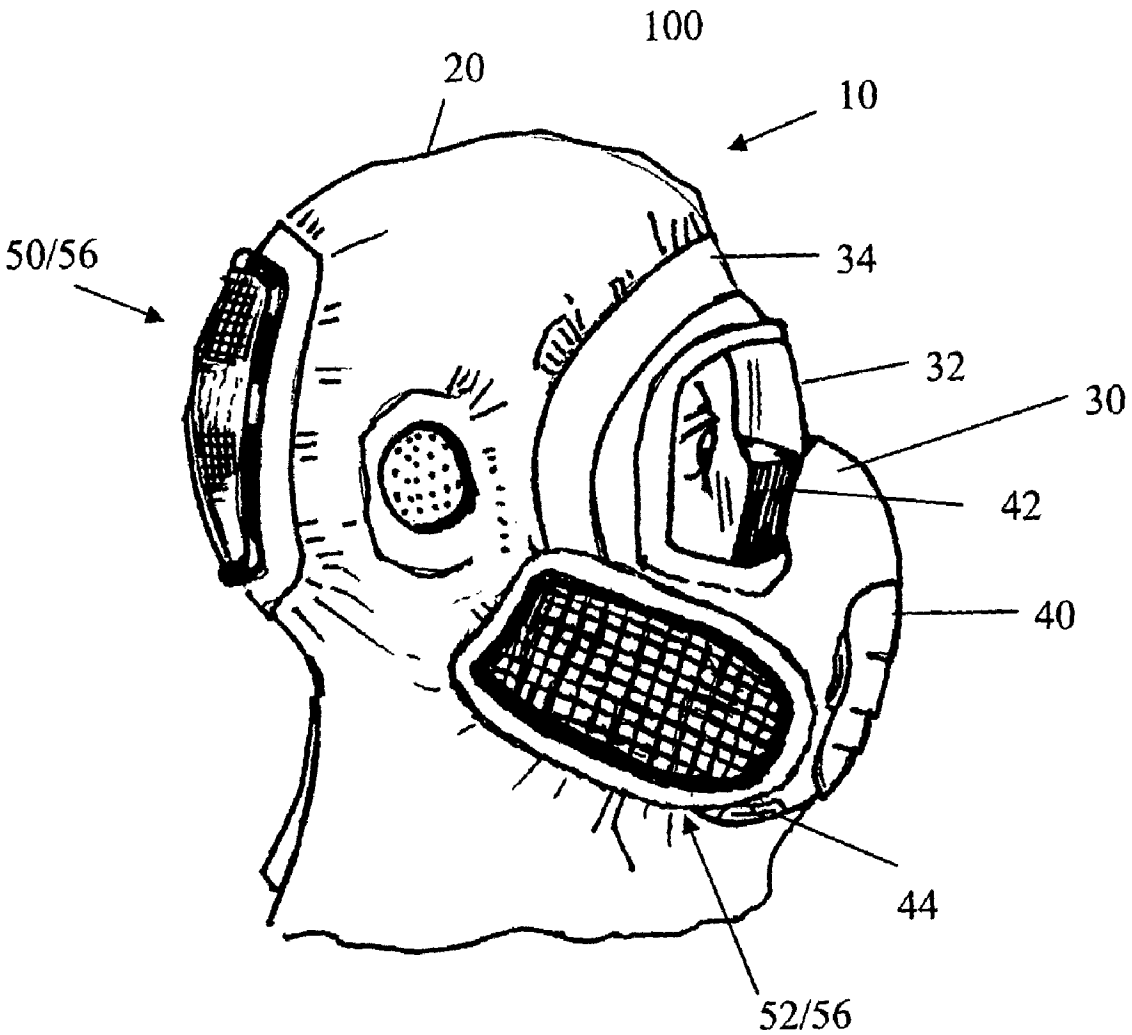
FIG. 1 illustrates an embodiment of the mask of the present invention.

As seen in FIG. 1, the chemical-biological protective mask 100 includes a head covering 10 that covers the wearer's head, with the head covering 10 having a hood section 20 within the aft top section of the head covering 10. The head covering 10 further includes a face piece 30 having a visor 32 integrated therein to provide a visual field-of-view to the wearer out of the head covering 10. Breathing by the wearer is facilitated by a filter 50 incorporated within the head covering 10. With the filter 50 mounted in the rear of the head covering 10, the chemical-biological mask 100 of the present invention effectively improves the center-of-gravity on the wearer's head by changing the weight distribution within the head covering 10 such that the center-of-gravity is centered over the shoulders of the wearer. After air enters the filter 50 located at the back of the hood section 20, the air passes to the wearer through a ducting system (not shown in FIG. 1) to the face piece 30, the air enters the face piece 30 through a duct in the face seal 34, passes over the visor 32, and is drawn into the nose cup 42 through nose cup inlet valve 46 (not shown in FIG. 1), and exhaled air is then passed through exhalation valve 40 in the front of the mask 100, or the exhaled air is directed back into the hood 20. Exhalation air valve 40 may comprise a slide valve which can be closed such that exhaled air is directed into the hood 20 through purge valve 44 rather than being directly exhaled to ambient. This redirection of exhaled air to the hood may be done as required in order to over-pressurize the hood and provide improved protection. Exhalation valve 40 may comprise any type of valve which can be manually closed by the wearer to redirect exhaled air to the hood 20. Such valves may comprise louvered slide valves, iris valves, or a sliding gate valve among others.

In one preferred embodiment where no filters are located at the front of the head covering 10, the elimination of filters from the front of the head covering 10 permits the visor 32 part of the head covering 10 to remain unobstructed by any forward filters. As such, the visor 32 provides an improved and substantial visual field-of-view for the wearer. Additionally, the removal of the forward filters allow for the incorporation of an expanded visor 32, when desired, to further expand the field of view. This field-of-view may include views in downward or lateral directions, or combinations of these directions. A substantial visual field-of-view includes views to the wearer without the interference of a filter located in the front part of the head covering 10. As such, views may be increased significantly over views hindered by such forward filter configurations, for example, improving the viewing area through the visor 32 with increases of 10% to 20% or more. The visor 32 may be appropriately configured for a given purpose, for example, with a configuration of a contoured shape, with a contour related to the wearer's facial contours preferred. A contoured configuration of the visor 32 allows for the lens portion of the visor 32 to be positioned closer to the wearer's eyes while eliminating the normally obstructed field-of-view caused when individual lenses are clamped or bonded into a mask. Additionally, the visor 32 may be specifically contoured for particular uses. Visor 32 contours may accommodate eye glasses, special operational equipment such as navigational or gun sights and the like, and other such uses that are determinable by those skilled in the art in light of the present disclosure.

The mask system 100 preferably contains a face seal 34 for sealing the face piece 30 and integral visor 32 to the face of the wearer and thereby protecting the face and eyes of the wearer. A standard strap suspension system attached to said face piece 30 may be used to secure the face seal 34 to the face of the wearer. Assembly of the visor 32 to the face piece 30 and face seal 34 can be readily accomplished as the assembly interface area is generally away from the lens of the visor 32. Possible assembly techniques for attaching the visor 32 to the seal 34 include bonding, insert casting, co-casting, insert molding, co-molding and/or other similar attaching techniques well known to those of ordinary skill in the art, and combinations thereof. Visor 32 construction materials include appropriate transparent materials that isolate the wearer from outside elements, with durability to adverse environments in which the mask 100 is used, such as, for example, polycarbonate, polyurethane and the like. Face seal 34 construction materials include compositions such as silicone and thermoplastic elastomers, and other appropriate elastomeric or rubber materials. Representative transparent materials for visor 32 include for example, without limitation, Sim 2058 optical polyurethane manufactured by Simula Technologies of Phoenix, Ariz. Representative face seal 34 materials include for example, without limitation, Rhodorsil 1556 manufactured by Rhodia Silicone of Cranbury, N.J. Representative bonding adhesives for attaching visor 32 to face seal 34 include for example, without limitation, NuSil Med I-4013 heat cure silicone adhesive manufactured by NuSil Silicone of Carpinteria, Calif.

Exhalation valve 40, preferably located within a nose-cup 42, is used to exhaust air from the interior of the head covering 10 to the ambient outside environment. On the other hand, air directed into the hood 20 is used to over-pressurize the hood 20, and after doing so ultimately leaks to ambient. As shown in FIGS. 3–8, in most embodiments nose cup 42 includes an inlet valve 46 through which air is drawn into the nose cup 42 from the face piece 30. In addition to the rear filter 50, side filters 52 may be included within the present invention (rear filter 50 and side filter 52 are collectively referred to herein as filters 56).

Filters 56 which are integrated into hood 20 are preferably designed to provide low breathing resistance. One particularly desirable filter 56 media includes a combination of carbon loaded composite media for vapor and gas filtration, and electrostatic media for particulate filtration. As such, the sorbent layers used for vapor and gas filtration of the filters 56 may be made from a carbon loaded composite media. Representative composite media for carbon loading includes, for example, without limitation, the composite media manufactured by KX Industries under the tradename PLEKX. Representative carbon loading materials include, for example, without limitation, ground carbon manufactured by Calgon under the tradename ASZM-TEDA carbon. This combination of carbon and composite media offers excellent sorbent filtration and low pressure drop characteristics. Preferably, the media is loaded to at least 1000 grams/$m^2$ of carbon and layered to provide the needed operational chemical protection, such as functioning within set safety standards. Use of four (4) layers is preferred for the redundant protection that is afforded to the wearer. Carbon mesh sizes can be varied to improve filter capacity or to reduce breathing resistance. The filter 56 surface area for the mask 100 of the present invention may comprise appropriate surface area for effective filtration of contaminants, with typical surface areas of the filters 56 ranging from about 50 $cm^2$ to about 500 $cm^2$, more preferably from about 100 $cm^2$ to about 350 $cm^2$, still more preferably from about 150 $cm^2$ to about 300 $cm^2$, and most preferably from about 200 $cm^2$ to about 250 $cm^2$.

Figure 2:
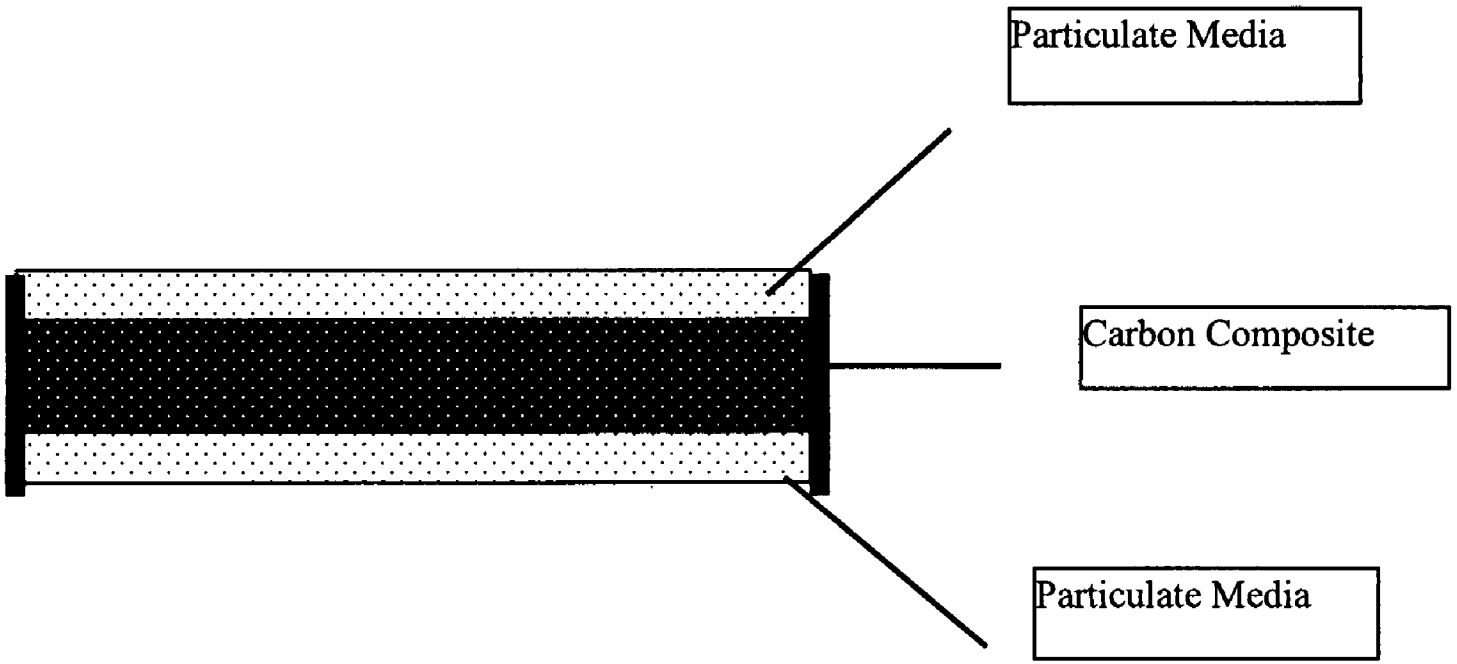
FIG. 2 shows a cut-away view of a filter useful in the present invention.

In addition, the filters 56 include particulate layers made from an electrostatic media. Particulate filtration media are included as an additional layer along with the carbon loaded web structure. Representative electrostatic media include, for example, without limitation, Advanced Electret Media manufactured by 3M of Minneapolis, Minn. This material offers excellent aerosol and particulate filtration and very low pressure drop characteristics. Preferably the electrostatic media is optimized to provide near HEPA performance, as determinable by one skilled in the art, such as at a depth of approximately 0.1 inches. As seen in the filter cut-away, shown in FIG. 2, layering the sorbent carbon structure and the particulate media produces one such desirable filter 56 assembly. FIG. 2 shows the carbon composite layered with particular media on both the outside and inside of the filter 56.

Additional features may be incorporated into the mask 100 of the present invention, such as front filters or low profile contoured filters 56 on the side and/or back of the mask 100. Although placement of front and/or side filters 52 on the mask 100, or additional filters 50 to the back, adds additional bulk to the mask, it also provides a significant increase in filtering surface area. Increases in surface area, over the original filter 50 system may be doubled or more. With this extension of the original filter 50 surface area, additional filter capacity is available or thinner filters 50, 52 and 56 may be used in one or more of the filter locations, e.g., the front and back or side and back locations. In addition, using the additional contoured filters 56, breathing resistance into the mask 100 may be further reduced to nearly half the resistance of a mask 100 using only the rear-mounted filters 50. Optionally, the separate front and/or side 52 filters may be used as primary or secondary filters in combination with the back filters 50, i.e., they may be used in parallel or series airflow patterns with the rear filter.

Figure 3:
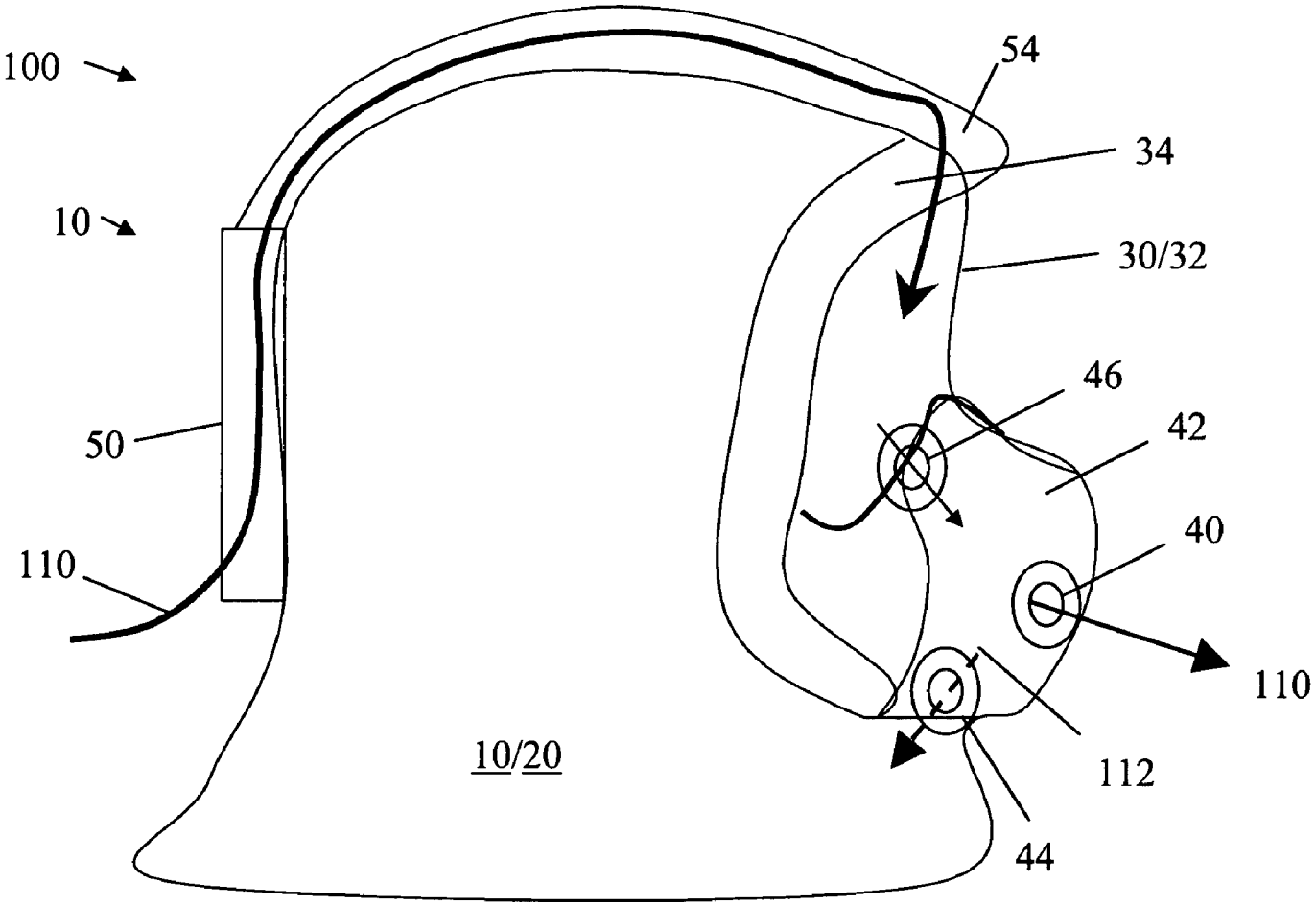
FIG. 3 illustrates the airflow within a mask embodiment of the present invention having a rear-mounted filter.
Figure 5:
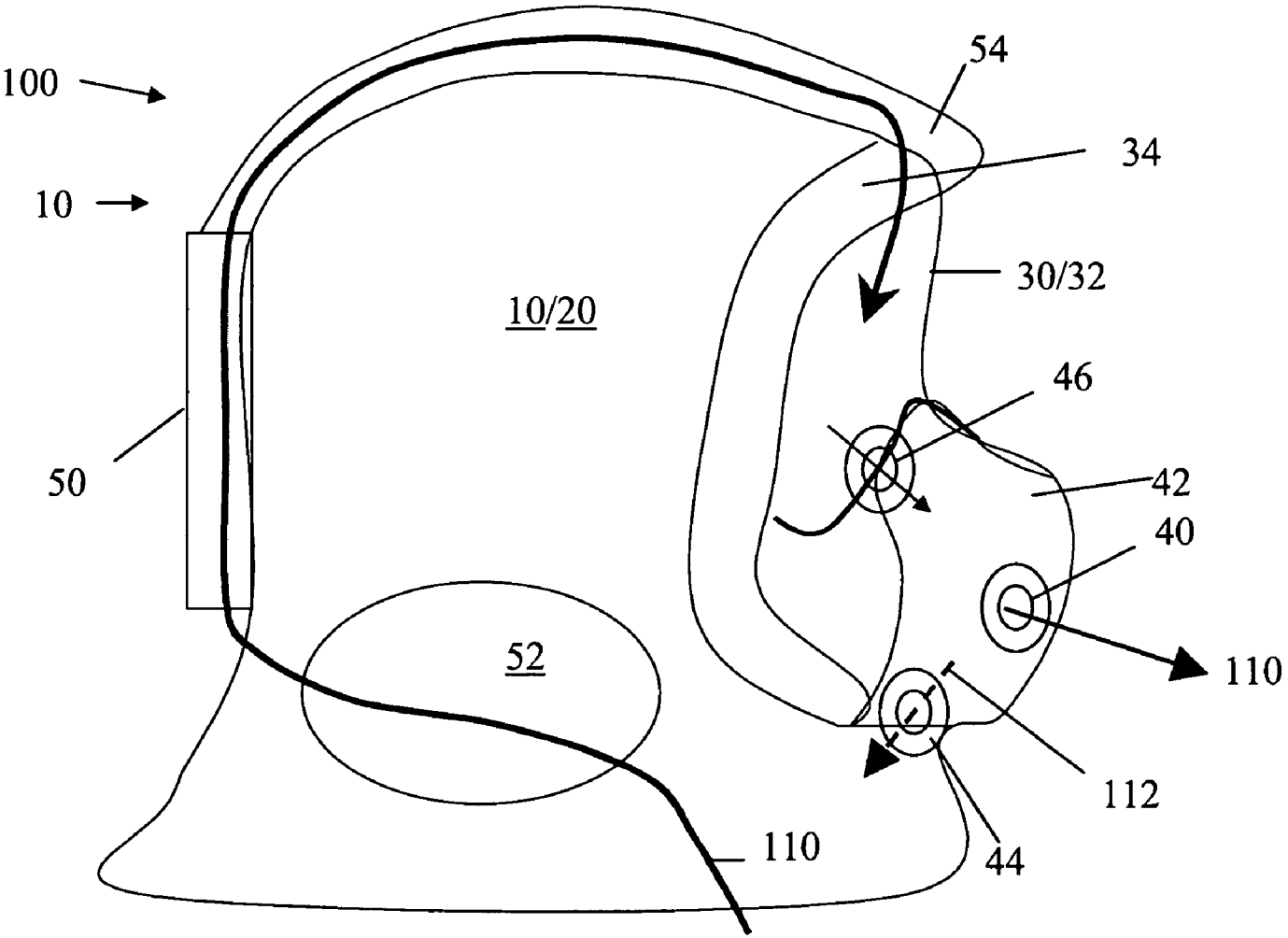
FIG. 5 illustrates the airflow within a mask embodiment of the present invention with front or side filters working in series with a rear-mounted filter.
Figure 6:
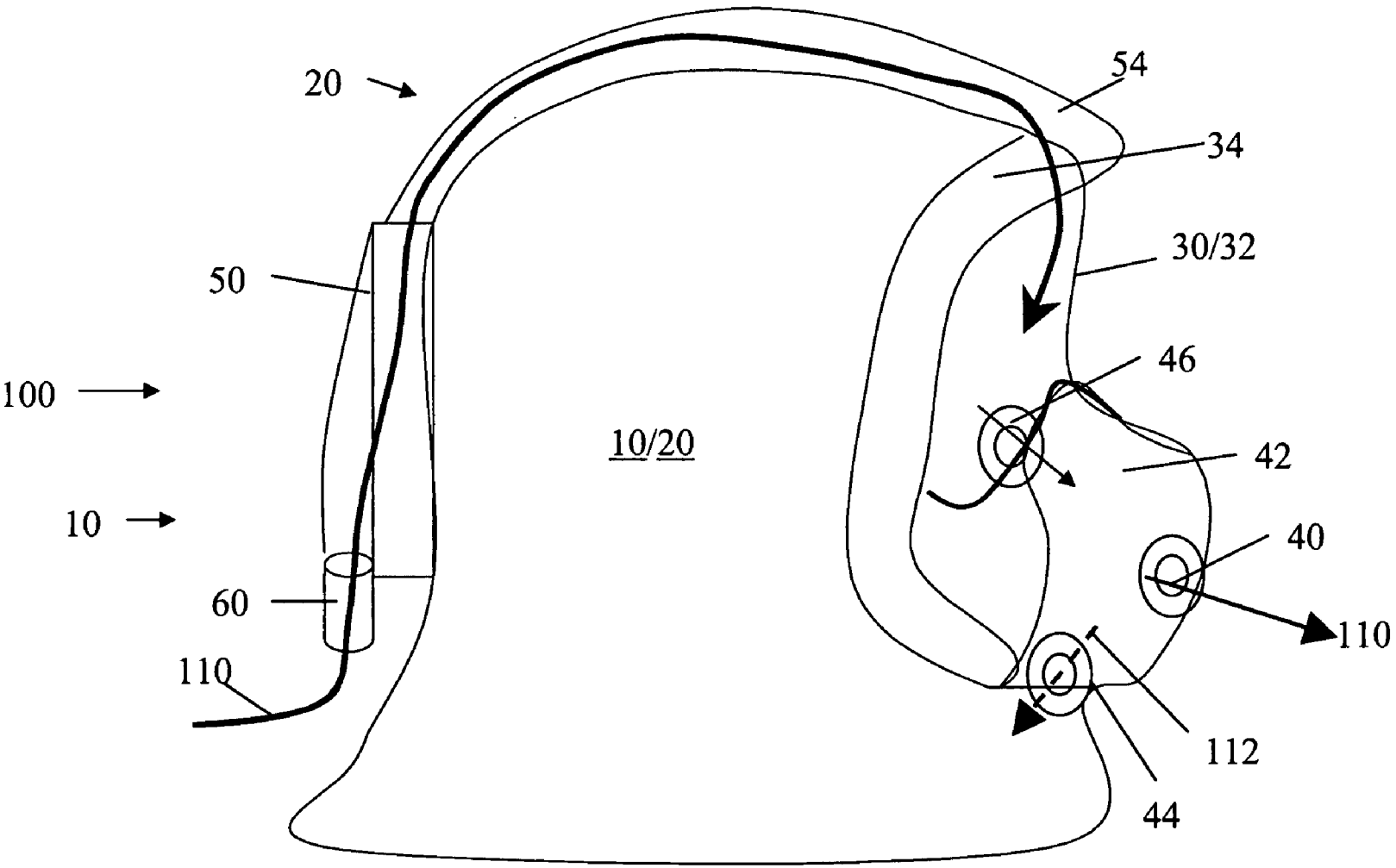
FIG. 6 illustrates the airflow within a mask embodiment of the present invention having a blower forcing air through a rear-mounted filter.

In a preferred embodiment, the present invention includes the head covering 10 with only rear mounted filters 50, as shown in FIGS. 3 and 6. The use of the rear mounted filters 50 greatly improves the stability of the head covering 10 for the wearer by creating a center-of-gravity which is centered over the shoulders of the wearer. The filters 50 are used to cleanse air drawn or forced into the head covering 10 which is then directed to the face piece 30 for respiration. In addition to the filters 50 mounted at the rear of the head covering 10 as shown in FIGS. 3 and 6, and additional side filters 52, such as those shown in FIGS. 1, 4, 5, 7, 8 and 9, other filters may be mounted at other positions on the head covering 10, such as the front of the head covering 10. Preferably, the filters 56 are detachably inserted into openings in the head covering 10 by snap fit or other means and, with the placement of the filters 56 therein, protect the interior environment of the head covering 10 from the exterior environment. Alternatively, more permanent edge sealing can be accomplished either with a silicone adhesive sealant or a thermoplastic edge seal adhesive. In either set of rear and side filters 56, a plurality of filters elements may be used for a given entry point into the head covering 10. Multiple filters are desirable to provide redundant protection against single or multiple chemical-biological threats, or may be used to facilitate the replacement of used filters. The plurality of filters may be incorporated into the mask 100 such that airflow through the filters is in parallel, in series, or a combination thereof.

Various air flow configurations within the mask 100 provide operational flexibility to the present invention, with one or more air flow configurations being possible for a given mask 100 of the present invention. A combination of the features may also be incorporated into a single mask 100. For example, in addition to the rear mounted filters 50, the mask 100 may include either or both front and/or side filters 52 for extra capacity, and different airflow configurations may be used through the mask 100. In addition, a small fan or motor blower may be used to force air into mask 100 through the rear filters 50 thereby greatly reducing breathing resistance. As previously discussed, added features generally incorporate additional bulk to one portion of the mask 100 but provide advantages, such as additional filter capacity or protection in the mask 100.

As seen in FIG. 3, airflow 110 can be conducted directly to the face-piece 30 or to the hood 20, as needed, to provide cooling and pressurization to the hood 20. Ducting 54 within the head covering 10 preferably provides a conduit for airflow 110 through the interior of the head covering 10. As shown in FIG. 3, a conformal ducting system 54 that transits across the top of the head covering 10 and includes a duct through face seal 34 is preferably used to connect the interior of the face piece 30 and visor 32 to the rear mounted filter 50. Although over-the-head ducting, as seen in FIG. 3 is preferred, alternative embodiments of ducting 54 are available, such as having the ducting passing under the ears or next to the chin of the wearer. Ducting 54 may be aligned and/or attached to the inside or outside of the head covering 10, or be structurally within the head covering material. Referring to FIG. 3, airflow 110 may be drawn through the rear-mounted filter 50 into the mask face-piece 30, and is then drawn into the nose cup 42 through inlet valve 46, and discharged through air exhalation valves 40 in the nose-cup 42. This inhalation airflow 110 pattern aids in the defogging of the visor 32. Exhaled air can be directed through the exhalation outlet valve 40 to the outside environment or optionally directed 112 into the hood 20 as overpressure to aid in purging the hood 20 assembly. Exhalation valve 40 preferably comprises a louvered sliding valve such that the wearer can close the exhalation valve 40 and force exhaled air through purge valve 44 into the hood 20, shown as 112.

Figure 4:
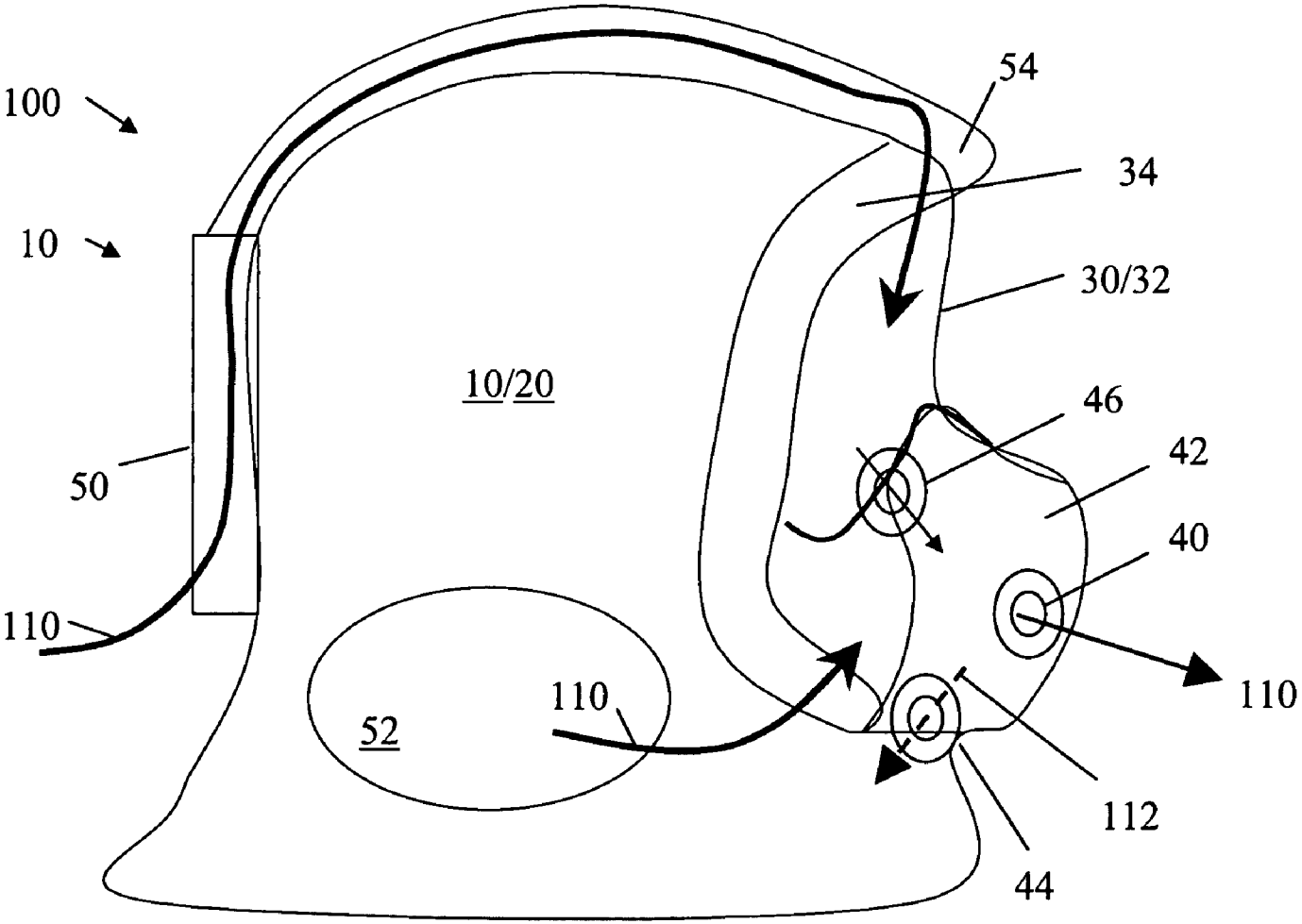
FIG. 4 illustrates the airflow within a mask embodiment of the present invention having an independent rear-mounted filter working in parallel with front or side filters.

In the airflow 110 configuration represented in FIG. 4, airflow 110 is drawn concurrently, i.e., in parallel, through the rear mounted filters 50 and side mounted filters 52 into the mask face-piece 30. From the face piece 30 the air is then drawn into nose cup 42 through inlet valve 46 and discharged through exhalation air valve 40 in the nose-cup 42. In this configuration, ducting directly connects side filters 52 to face piece 30 for airflow. The addition of the secondary filters 52 in parallel with the primary rear-mounted filters 50 both enhances the filtration capacity of the mask 100 and reduces the breathing resistance due to the added surface area. Similar to the configuration shown in FIG. 3, exhaled air can be directed through an outlet valve 40 to the outside environment or optionally directed 112 into the hood 20 as overpressure to aid in purging the hood 20 by closing valve 40 and directing air through purge valve 44.

In the airflow 110 pattern shown in FIG. 5, airflow 110 is drawn through rear-mounted filters 50 that are in series with side mounted filters 52 and then into the mask face-piece 30. Addition of the secondary filters 52 in series enhances the filtration capacity of the mask 100, but also increases the breathing resistance due to the added filter bed area. This addition of the secondary filters in series provides a stacking effect that is particularly useful for environments having multiple types of toxic substances, such as toxic industrial chemicals. In the configuration shown in FIG. 5, stacking is possible without adversely affecting the center-of-gravity of the mask 100 since the combined filter 56 weight is distributed at the rear and side of the mask 100. Airflow 110 can be forced directly to the face-piece 30, and then drawn into nose cup 42 through inlet valve 46, and exhaled from nose cup 42 through outlet valve 40, or redirected 112 to the hood 20 through purge valve 44 by closing valve 40, as needed, to provide cooling and pressurization for the hood 20. This approach provides an additional hood 20 purging effect within the mask 100 to enhance protection to the wearer from contaminants.

As further seen in the airflow 110 configuration in FIG. 6, airflow 110 is pushed through the rear-mounted filters 50 by a small head-mounted fan or blower 60, through ducting 54 and into the mask face-piece 30. Air is then drawn into nose cup 42 through inlet valve 46, and discharged through air exhalation valve 40 in the nose-cup 42, also using the small fan or blower system 60. The addition of the small fan or blower 60 provides some overpressure to the face-piece 30 to improve protection and reduce the breathing resistance. The high surface area and low resistance of the rear-mounted filters 50 allows for the use of a fairly small blower unit 60. Representative blowers 60 include for example, without limitation, the Micronel C301 fan manufactured by Micronel U.S. of Vista, Calif. Airflow 110 provided by the blower 60 should be sufficient for pressurization of the mask 100 and/or cooling to the wearer, with representative airflow being from about 0.5 CFM to about 5 CFM, including a preferred airflow of from about 1 CFM to about 2 CFM. As shown in previous embodiments, exhalation valve 40 may be closed to force exhaled air through purge valve 44 and provide a purge and overpressure airflow 112 to hood 20.

Figure 7:
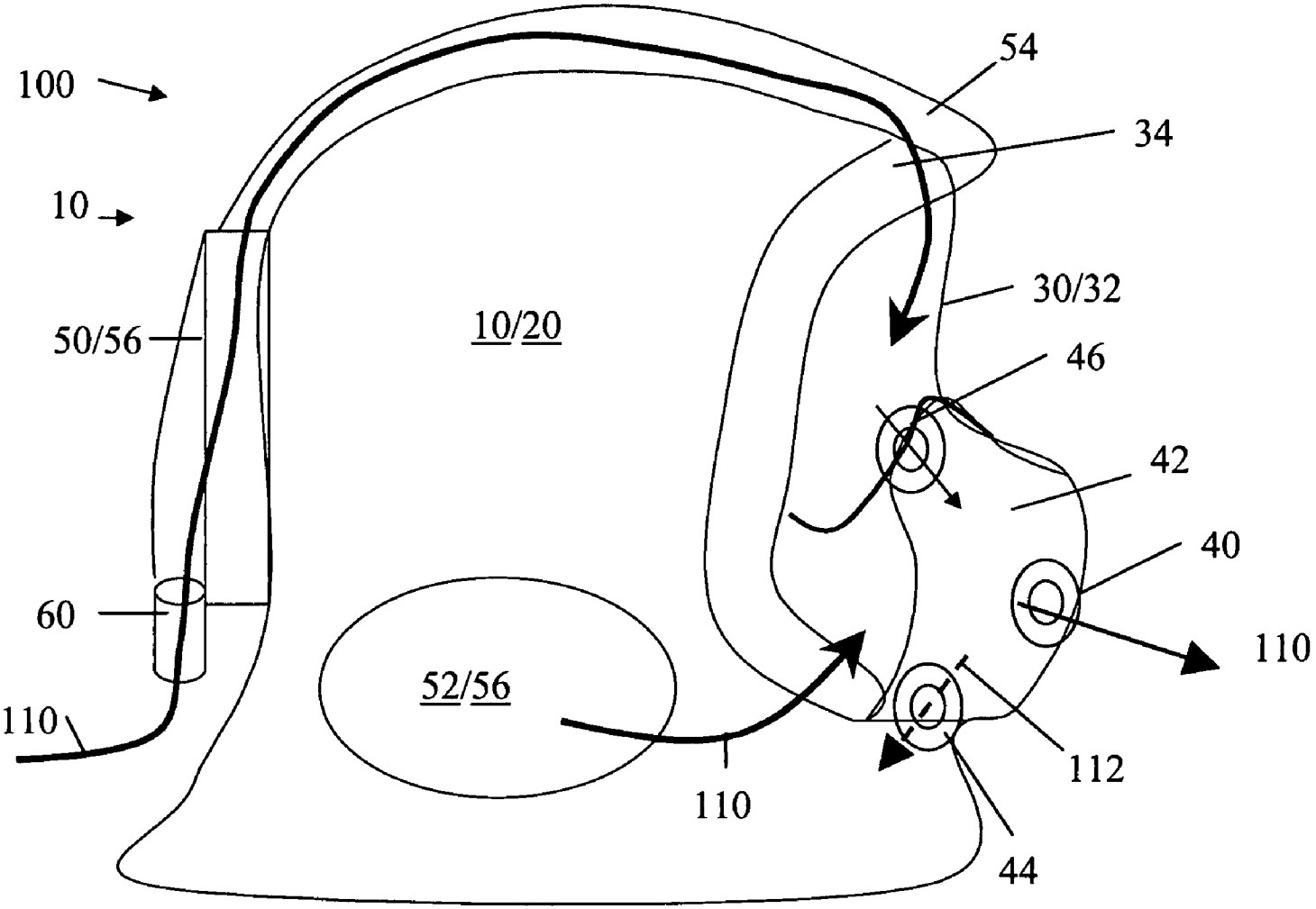
FIG. 7 illustrates the airflow within a mask embodiment of the present invention having a blower forcing air through a rear-mounted filter in combination with independent front or side filters providing parallel airflow to the face piece.

In FIG. 7, airflow 110 is pushed through the rear-mounted filters 50 into the mask face-piece 30 using a small head-mounted fan or blower system 60 while airflow 110 is also drawn through the side mounted filters 52 and ducted directly to face piece 30. The air in the face piece 30 can then be drawn into the nose cup 42 through inlet valve 46. In this configuration, airflow 110 can be balanced to provide enhanced protection and filtration capacity as well as reduced breathing resistance. Here again, as shown in previous embodiments, exhalation valve 40 may be closed to force exhaled air in the nose cup 42 out through purge valve 44 and provide a purge and overpressure airflow 112 to hood 20.

Figure 8:
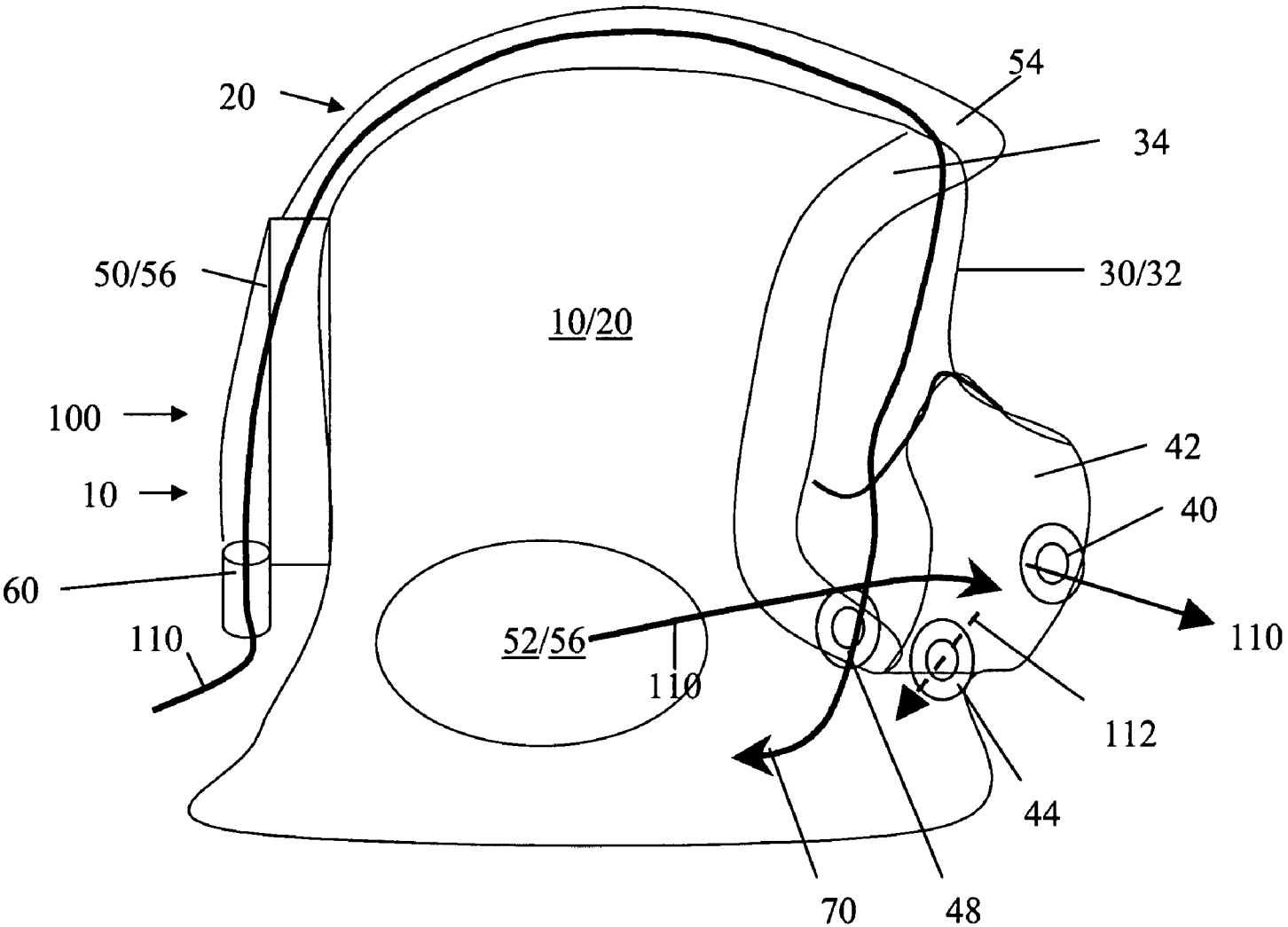
FIG. 8 illustrates the airflow within a mask embodiment of the present invention having a blower forcing air through a rear-mounted filter that circulates directly into the hood, while side or front filters provide air directly to the face piece.

Another alternative embodiment, as shown in FIG. 8, uses an airflow 110 pattern that provides higher protection performance. After the airflow 110 is pushed through the rear-mounted filters 50 into the mask face-piece 30 using a small head-mounted blower system 60, the airflow 110 bypasses the nose-cup 42 and is purged directly into the hood 20 using a secondary valve 48. In this embodiment no nose cup inlet valve is required. In FIG. 8, airflow 110 for breathing is drawn through the side mounted filters 52 only and is directed directly into nose cup 42. Although filter capacity is not increased in this configuration, protection is significantly improved by purging both the face-piece 30 and hood 20. A diverter 70 may be used to redirect the airflow from the blower 60 within the head covering 10, such as redirecting the airflow 110 between the face-piece 30 and the hood 20 of the head covering 10.

Figure 9:
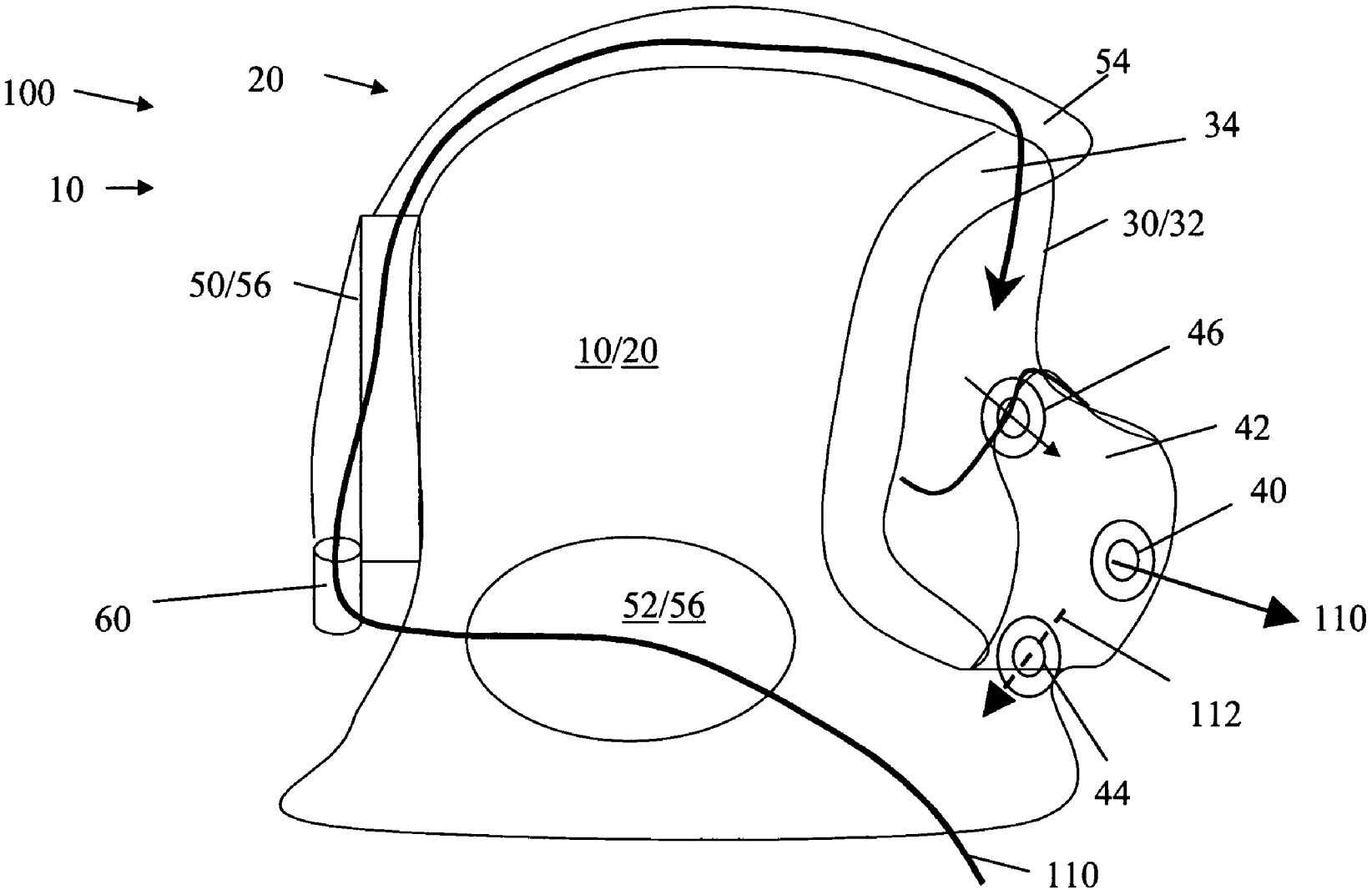
FIG. 9 illustrates the airflow within a mask of the present invention with a blower forcing air through rear-mounted filters and side and/or front filters which are acting in series with said rear-mounted filter.

The airflow 110 pattern shown in FIG. 9 shows airflow 100 drawn through the side filters 52 and then the rear-mounted filters 50, in series, then into the mask face-piece 30 using a small head-mounted blower system 60. Air can then be drawn into the nose cup 42 through inlet valve 46. Here again, exhaled air can be directed through an outlet valve 40 to the outside environment or optionally directed 112 into the hood 20 through purge valve 44 as overpressure to aid in purging the hood 20 by closing outlet valve 40.

Alternative configurations allow for the incorporation of a head mounted blower and/or additional front mounted filters. This provides the wearer with options to tailor the protection and filter capacity to suit the mission. It is envisioned that the wearer could engage the filters collectively or as a primary and secondary filter option. It is also envisioned that the wearer could redirect blown air directly to the face piece or to the hood for additional cooling and protection. Unlike previously known mask systems, the present invention may be effectively adapted to utilize multiple filter configurations.

The chemical/biological protective mask 100 of the present invention provides a balanced system for dealing with contamination through improved center-of-gravity forces imparted onto the wearer that occurs with the adjustment of the weight distribution within the mask 100. The present invention provides the wearer of protective equipment an expanded visual field-of-view, lower breathing resistance, improved protection and improved compatibility. Because much of the facial bulk is removed, the lens or visor system can be expanded to improve visual field-of-view. Compatibility with external sighting systems and rifle firing is improved since the filters have been moved from the front of the mask. A larger filter surface area provides for lower breathing resistance and the potential for higher filter capacity. Protection is also improved by removing the weight of the filters from the face, which minimizes torque of the face-piece and allows for use of a softer seal material. Finally, alternative airflow patterns allow the mask to be tailored for particular applications, and the mask provides the ability for the user to modify the airflow as required. For example, the mask can be adjusted so that exhaled air is directed to the hood for over-pressurization rather than being exhaled to the outside environment.

The foregoing summary, description, and examples of the present invention are not intended to be limiting, but are only exemplary of the inventive features which are defined in the claims. Alternative materials and configurations to those described herein for the present invention may be used.

What is claimed is:

1. An operationally adaptable chemical-biological protective mask, comprising:

a head covering effective for fully covering the wearer's head, wherein the rear and top sections of said head covering comprises a hood and the front of said head covering comprises a face piece; wherein said face piece has at least one visor effective for providing a visual field of view to the wearer, said face piece is securely attached to said hood, and wherein said face piece includes a face seal for sealing the face piece to the wearer's face;

a nose cup positioned within said face piece to fit over the mouth and nose of the wearer, said nose cup having an inlet valve, an exhalation outlet valve comprising a valve which can be closed by the wearer, and a purge valve for directing air into said hood when said outlet valve is closed by the wearer;

an air supply port positioned at the rear of said hood for permitting outside air to be supplied to the inside of said head covering;

one or more rear filters mounted in combination with said rear mounted air supply port, wherein said one or more rear mounted filters cleanse air flowing into said head covering; and, ducting adjacent to said head covering and connecting said rear-mounted air supply port to said face piece, said ducting providing a conduit for filtered air from said rear mounted supply port into said face piece.

2. The protective mask of claim 1, further comprising one or more side filters mounted on one or more side air supply ports, with each having ducting connecting said side filters to said face piece so that additional outside air is supplied directly to said face piece through said one or more side filters, so that said rear mounted filters and said side mounted filters act in parallel.

3. The protective mask of claim 2, further comprising a blower mounted directly to said mask to force air through said rear mounted filters and into said face piece.

4. The protective mask of claim 3, wherein said blower system provides an airflow to said head covering of from about 1 CFM to about 2 CFM.

5. The protective mask of claim 2, further comprising front mounted filters.

6. The protective mask of claim 1, further comprising one or more side filters mounted on the sides of said head covering, with each having ducting connecting said side filters to said rear mounted filters, to direct outside air through said side mounted filters and said rear mounted filters in series.

7. The protective mask of claim of claim 6, further comprising a blower mounted directly to said mask and attached to ducting to force outside air through said side and rear mounted filters in series.

8. The protective mask of claim 7, wherein said blower system provides an airflow to said head covering of from about 1 CFM to about 2 CFM.

9. The protective mask of claim 1, wherein said nose cup has no inlet valve, and said face piece includes a bypass valve so that air drawn through said rear mounted filters is conducted directly into said hood for over-pressurization, and further including side mounted filters with ducting to conduct outside air directly into said nose cup for breathing by the wearer.

10. The protective mask of claim 9, further comprising a blower mounted directly to said mask to force air through said rear mounted filters and into said face piece.

11. The protective mask of claim 1, wherein said face piece visor provides a substantial visual field-of-view in upward, downward, and lateral directions.

12. The protective mask of claim 1, wherein said face piece visor has a shape contoured to the wearer's face.

13. The protective mask of claim 1, wherein said ducting traverses across the top of said head covering, and adjacent to said head covering.

14. The protective mask of claim 1, wherein said rear filters comprise a surface area of from about 200 $cm^2$ to about 250 $cm^2$.

15. The protective mask of claim 2, wherein said side filters comprise a surface area of from about 200 $cm^2$ to about 250 $cm^2$.

16. The protective mask of claim 6, wherein said side filters comprise a surface area of from about 200 $cm^2$ to about 250 $cm^2$.

17. The protective mask of claim 9, wherein said side filters comprise a surface area of from about 200 $cm^2$ to about 250 $cm^2$.

18. The protective mask of claim 1, wherein said mask is balanced by adjusting the weight distribution within said mask to provide a center-of-gravity.

* * * * *